US007134645B1

(12) United States Patent
Johnson et al.

(10) Patent No.: US 7,134,645 B1
(45) Date of Patent: Nov. 14, 2006

(54) WINCH ASSEMBLY FOR USE WITH SYNTHETIC ROPES

(75) Inventors: Eric Arthur Johnson, Greene, NY (US); Stuart Leigh Phoenix, Ithaca, NY (US)

(73) Assignee: Advanced Design Consulting USA, Lansing, NY (US)

( * ) Notice: Subject to any disclaimer, the term of this patent is extended or adjusted under 35 U.S.C. 154(b) by 106 days.

(21) Appl. No.: 10/358,911

(22) Filed: Feb. 5, 2003

(51) Int. Cl.
*B66D 1/36* (2006.01)

(52) U.S. Cl. ..... 254/338

(58) Field of Classification Search ..... 254/214, 254/225, 226, 228, 242, 334, 338, 340
See application file for complete search history.

(56) References Cited

U.S. PATENT DOCUMENTS 982,500 A * 1/1911 Iliffe ..... 74/89.14
3,843,096 A * 10/1974 Wilson et al. ..... 254/270
3,874,517 A * 4/1975 Raven et al. ..... 212/89
3,934,482 A * 1/1976 Byers ..... 474/9
4,005,852 A * 2/1977 Schmitmeyer et al. ..... 254/266
4,251,059 A * 2/1981 Fougea ..... 254/338
5,076,398 A 12/1991 Heikkinen
5,186,283 A 2/1993 Salmon
5,233,139 A * 8/1993 Hofmann ..... 187/393
5,370,205 A * 12/1994 Vanhala ..... 187/264
5,566,786 A 10/1996 De Angelis et al.
6,164,053 A 12/2000 O'Donnell et al.
6,193,016 B1 2/2001 Hollowell et al.
6,193,017 B1 2/2001 Köster
6,318,504 B1 11/2001 De Angelis
6,397,574 B1 6/2002 De Angelis
6,631,885 B1 * 10/2003 Halas ..... 254/225

FOREIGN PATENT DOCUMENTS

JP 2001340666 A * 12/2001

* cited by examiner

*Primary Examiner*—Emmanuel M Marcelo
(74) *Attorney, Agent, or Firm*—Leo B. Kriksunov

(57) ABSTRACT

A winch assembly is disclosed that eliminates rope crushing, even when synthetic ropes are used. Tension is applied to the rope by at least one traction sheave so that the tension at the drum is reduced. By using multiple sheaves with large wrap angles traction can be applied to the rope over a much larger area, reducing shear stress and minimizing internal wear due to relative motion of rope components. The winch drum and at least one traction sheave are driven independently, preferably by AC induction motors using frequency control. The winch assembly may operate in conjunction with a hydraulic tensioner so that lower horsepower motors can be used to maintain constant tension in moving systems.

8 Claims, 3 Drawing Sheets

WINCH ASSEMBLY FOR USE WITH SYNTHETIC ROPES

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of rope or cable tensioning devices and more specifically to a winch assembly for use with synthetic or organic ropes.

Winch drums are widely used for tensioning and storing wire ropes. They are simple, robust and, if properly designed, long-lasting. They are not, however, compatible with synthetic ropes which can be crushed by the compressive forces that accumulate as rope is spooled onto the winch drum under tension.

Steel used for wire ropes is nearly isotropic and resists crushing well. It has a high tensile strength and stiffness along with good wear resistance. Modern synthetic ropes, made from materials such as Kevlar™ and Vectran™, have even higher strength and stiffness in the longitudinal direction with much lower weight and vastly superior corrosion resistance. (Kevlar is a trade mark of DuPont de Nemours Co. Vectran is a trade mark of Hoechst Celanese Corp.) For applications where weight, strength, stiffness, corrosion resistance or rope flexibility are important synthetic ropes are preferred. Examples are elevators, hoists, cranes, tensioners in deep-sea rigs and lines used in Underway Replenishment at sea. Unfortunately these synthetics are highly anisotropic and can be easily damaged by stresses oriented orthogonal to the fiber direction. They are also subject to rapid wear and fibrilation due to stresses that arise when fibers move within the rope. For these reasons it is important to carefully manage stress within a synthetic rope in any application.

Elevators have successfully used synthetic ropes for considerable time. This application is, however, distinct from winches since there is no spooling of rope—crushing loads are therefore of no concern. Rope wear and the application of large traction forces to the rope are, however, concerns that are shared with winch systems.

De Angelis et al (U.S. Pat. No. 5,566,786-1996) is one of many patents that describes a synthetic rope for use with elevators or lifts. Typical of these patents, De Angelis makes claims for structures that are "for the protection of the fibers . . . ". Subsequent patents by De Angelis (U.S. Pat. Nos. 6,318,504 and 6,397,574) teach the use of "an elastic intersheath between the layers of strands . . . to assist in transmitting torque within the rope over a large area." The need for shear transfer from the outer surface to the interior of the rope has been recognized but the inventor fails to appreciate that this problem can be better accomplished by using a large contact area between the traction sheave and the rope. Increasing the sheave diameter has no effect on the tension that can be applied but reduces the shear stress within the rope.

It is well known that the tension that can be applied to a rope by a traction sheave is expressed by the ratio $T_1/T_2=e^{\mu\alpha}$, where $T_1$ and $T_2$ are the tensions of the rope entering and exiting the sheave, $\mu$ is the coefficient of friction and $\alpha$ is the wrap angle of the rope around the sheave in radians. Both friction coefficient and wrap angle have been exploited as a means to increase the load that can be transmitted by a traction sheave.

In O'Donnell et al (U.S. Pat. No. 6,164,053) "the material for the jacket and sheave liner are selected to optimize the coefficient of friction between the hoist rope and traction sheave." Other inventors have claimed high-friction coatings or surface roughening to achieve the same result. In Heikkinen (U.S. Pat. No. 5,076,398) and in other patents the wrap angle is increased to nearly 270° by using one or more idler sheaves that are displaced from a traction sheave by a short distance along their rotational axes. This approach can cause excessive rope wear unless the sheave's groove is modified, which is undesirable as it allows excessive distortion of the rope with consequent internal wear. Ungrooved drums have been proposed by, for example, Salmon (U.S. Pat. No. 5,186,283) to achieve wrap angles in excess of 360° but eliminating the groove greatly increases rope distortion and wear.

In a patent by Köster (U.S. Pat. No. 6,193,017) multiple traction sheaves are used to tension a rope supporting an elevator. The sheaves are arranged such that wrap angles of more than 180° can be achieved. With this design very high tension can be achieved and the counterweight can be eliminated. (Hollowell et al contains similar teaching in U.S. Pat. No. 6,193,016 but these claims were anticipated by Köster).

All of the cited patents seek to increase the amount of tension that can be applied to a rope however none address the crushing that occurs on winch drums. In addition little thought has been given to how the sheaves can be driven when more than one are used to apply traction. In one embodiment Köster teaches that "The traction sheaves . . . may be driven via a common motor, with the use of a suitable transmission gearing . . . " although it must be noted that this is not the preferred embodiment. Such an arrangement ignores the change in length that occurs with changes in rope tension—with the result that slip is introduced between the rope and the sheaves if these latter are not independently driven. Hollowell et al make a similar statement: the multiple traction sheaves are driven by "one or more prime movers . . . "

No identified prior art addresses the problem that exists in wrapping a rope, particularly a synthetic rope, onto a drum at high tension. Motors and controllers that would allow tension or rotational velocity to be independently controlled over multiple traction sheaves and a winch drum have not been disclosed. The prior art is insufficient to design a winch system that is compatible with synthetic ropes.

BRIEF SUMMARY OF THE INVENTION

The primary object of the invention is to wrap a rope or cable onto a winch drum at a relatively low tension so that crushing forces on the rope are reduced, thereby eliminating a common failure mode.

Another object of the invention is to apply traction over a large area on the surface of a rope, thereby reducing internal movement and wear.

Another object of the invention is to provide redundancy within the winching system in order to prevent catastrophic failures.

A further object of the invention is to minimize the space required for the various components.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a device that applies tension to a flexible tensile member comprising: a flexible tensile member such as a rope or cable; a winch or take-up reel to which said flexible tensile member is attached; a means to apply torque to said winch or take-up reel; at least one traction sheave and means to apply torque to said at least one traction sheave.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
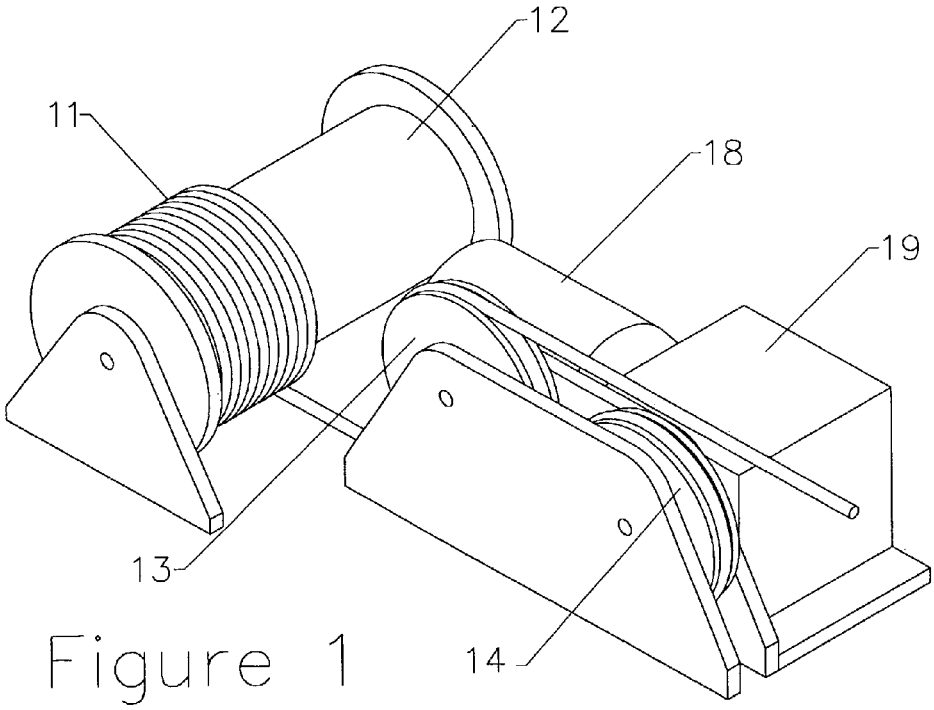
FIG. 1 is a perspective view of the invention embodied by a rope, a traction sheave, a motor, gear-box, mounting flanges, an idler sheave and a take-up drum.
Figure 2:
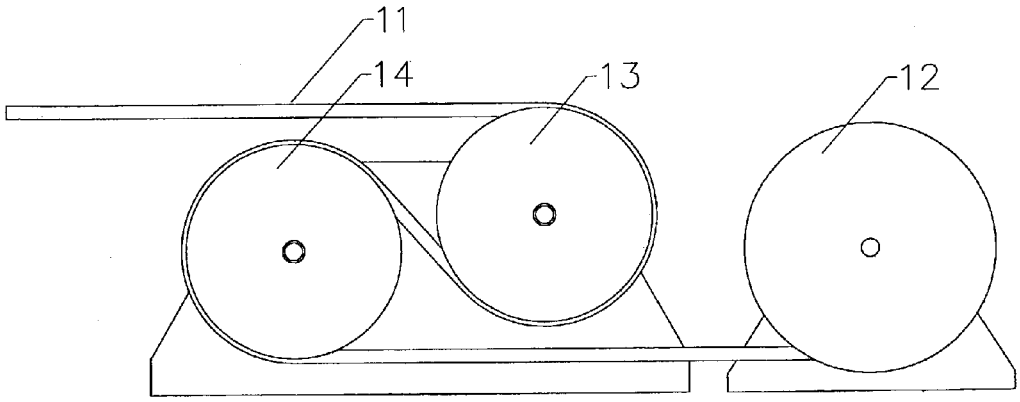
FIG. 2 is a side view of the embodiment shown in FIG. 1 showing two sheaves, a take-up drum and the routing of the rope with the motor, gear-box and supports removed for clarity.

FIG. 1 shows a first embodiment of the winch system specifically designed for use with a flexible tensile member, and in particular with a synthetic, also termed organic, cable or rope. The rope 11 is spooled onto a reel or take-up drum 12 for storage. One end of rope 11 is fixed to the drum 12 in any of several manners that are well-known to those versed in the art. The rope 11 runs beneath a first sheave 13, without contacting it, to a second sheave 14 with which it is in contact. Rope 11 wraps around sheave 14 for close to 225° and then runs beneath sheave 13 with which it is also in contact. After passing around sheave 13 for approximately 225° rope 11 exits the winch system. Although it is advantageous to provide a large wrap angle the system can also function with much smaller wrap angles. The rope 11 typically passes over additional sheaves or pulleys (not shown) before being attached to an object to which a load is to be applied. The routing of rope 11 can be more easily seen in FIG. 2. Only the rope 11, take-up drum 12 and sheaves 13 and 14 are shown in this side-view of the embodiment shown in FIG. 1.

The take-up drum 12 and at least one of the sheaves 13 and 14 are powered by motors. Referring once again to FIG. 1 sheave 14 is attached to motor 18 through a gear-box 19 and drive shaft (not shown). Drum 12 is driven by a separate motor (not shown). Sheave 13 is unpowered and serves to increase the wrap angle of rope 11 on sheave 14. This wrap angle is important since the tension that may be applied to a rope by a sheave is approximately $T_1/T_2=e^{\alpha\mu}$. If rope 11 is made from Kevlar™ with a Kevlar™/polyester jacket and sheave 14 is stainless steel the friction coefficient $\mu$ is about 0.19. Using the equation given above it may be shown that, for the wrap angle and friction coefficient of this embodiment, the tension in rope 11 can be increased by a factor of about 2 from the point at which it leaves drum 12 to that at which it leaves sheave 14. Thus, the torque applied to sheave 14 by motor 18 and gear-box 19 should be twice that of the torque applied to drum 12. In this way the tension of rope 11 as it is wrapped about drum 12 is reduced to a third of the final tension applied by the winch system. The tension in rope 11 as it is wrapped about drum 12 can be further reduced if both sheaves 13 and 14 are powered.

Reducing the tension in rope 11 as it is wrapped on take-up drum 12 is the primary benefit of this invention. Synthetic ropes made from Kevlar™, Vectran™ and other materials are particularly vulnerable to crushing as layers of rope are wrapped on drum 12. Each successive layer increases the compressive force acting radially on the drum. Steel ropes can be used with little danger of crushing but this problem has prevented the use of synthetics for winch applications such as hoists, cranes, risers used for deep-sea rigs and high-lines for naval replenishment.

The reduction in tension in rope 11 at drum 12 can be enhanced by using additional driven sheaves or by increasing the friction coefficient $\mu$ at the driven sheaves. For example, adding a rubber coating to sheave 14 in this embodiment would increase $\mu$ to about 0.80, resulting in a potential increase in tension by a factor of about 23 from the point at which the rope leaves drum 12 to that at which it leaves sheave 14. While this allows very low tensions to be used at the take-up drum 12, which is desirable to prevent rope crushing, particles may become embedded within the coating resulting in abrasion and early failure of synthetic ropes.

A more desirable means of reducing the tension in drum 12 is to provide power to both sheaves 13 and 14. If the same torque is applied to both sheaves 13 and 14 the tension in a Kevlar™ rope 11 as it is wrapped on drum 12 is reduced to about a fifth of the total tension applied by the winch system. Equal torque applied to the driven sheaves has the advantage of providing a uniform shear stress within the rope as it passes around each of the driven sheaves.

Alternatively, but less desirably, sheave 13 can be driven at a higher torque. In the case where $\mu$=0.19 and the wrap angle about both sheaves 13 and 14 is 225°, the torque on sheave 13 can be twice that applied to sheave 14. In this case the tension in the rope as it is wrapped on drum 12 is a seventh of the final tension applied by the winch system. Limiting shear stress is an important consideration in the synthetic rope 11 since it can produce relative motion of internal rope components that can lead to premature wear.

Figure 3:
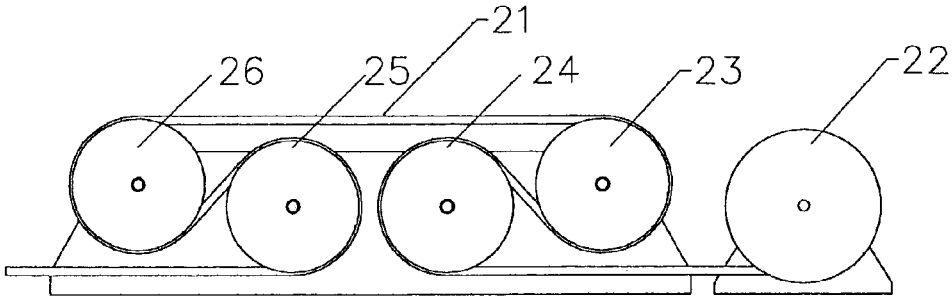
FIG. 3 is a side view of an alternate embodiment with four sheaves and a take-up drum.

If both sheaves 13 and 14 are powered it is preferred that independent motors are used; although less preferable, it is possible to use one motor to drive both sheaves. This preference is described in relation to a second embodiment, which uses four sheaves, as shown in FIG. 3. Up to four of sheaves 23 to 26 can be powered either by a single motor operating through a gear train or, more preferably, by individual motors (motors not shown). Individual motors are preferred because sheaves 23 to 26 must rotate at slightly different rates, that depend upon the tension in rope 21, if slip is to be avoided. This difference in rotational speed is necessitated by the change in tension of rope 21 as it passes through the drive system. Tension increases as rope 21 passes in turn around sheaves 24, 23, 26 and 25 and with each increase in tension there is a corresponding elongation of the rope. Therefore, the velocity of a point on rope 21 must also change slightly as it passes through the winch system. If sheaves 23 to 26 are driven by a single motor and gear train such that all rotate at the same rate the change in velocity arising from elongation of the rope, although small, will produce slip on the sheave surfaces resulting in premature wear to the surface of rope 21. If the final tension in the rope were to always be the same then the sheave diameters could be modified to eliminate slip but this case is not particularly useful.

The main advantage of the embodiment of FIG. 3 is the increased contact area between rope 21 and the four sheaves 23 to 26. Each additional driven sheave increases this contact area and proportionally reduces the local shear force that is transmitted to rope 21. Reducing this shear force also reduces relative motion within the rope thereby reducing wear and increasing life. The same increase in contact area could be achieved using sheaves with larger diameters, however, the size of the winch system and the rotary inertia of the sheaves are reduced when many small sheaves are used. Multiple sheaves can also provide a degree of redundancy if one drive motor fails thereby increasing reliability and safety.

Figure 5:
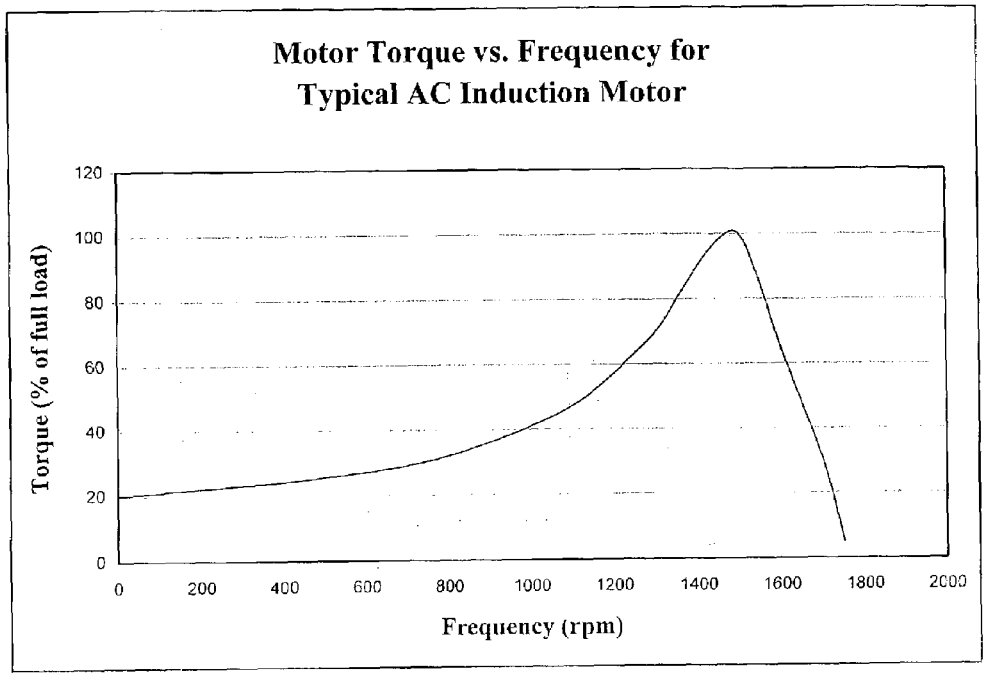
FIG. 5 is a graph of the torque and speed characteristics of a typical AC induction motor.

Referring once again to FIG. 1, the amount of torque applied to the drum 12 and traction sheave 14 can be controlled in various ways. Motors may be selected with different torque characteristics so that, for example, motor 18 applies twice as much torque to sheave 14 as the motor attached to drum 12 (not shown) when operating at the same speed. This may easily be accomplished using AC induction motors with different torque/speed characteristics. A torque/speed curve for a typical AC induction motor is illustrated in FIG. 5. Hydraulic motors can also be used. Clutch plates, hydrostatic transmissions and other well-known drive mechanisms may be incorporated into the winch system. Alternatively, variable frequency controllers can be used with AC induction motors to improve the performance of the winch system. Such variable frequency controllers are widely used by those versed in the art.

Figure 4:
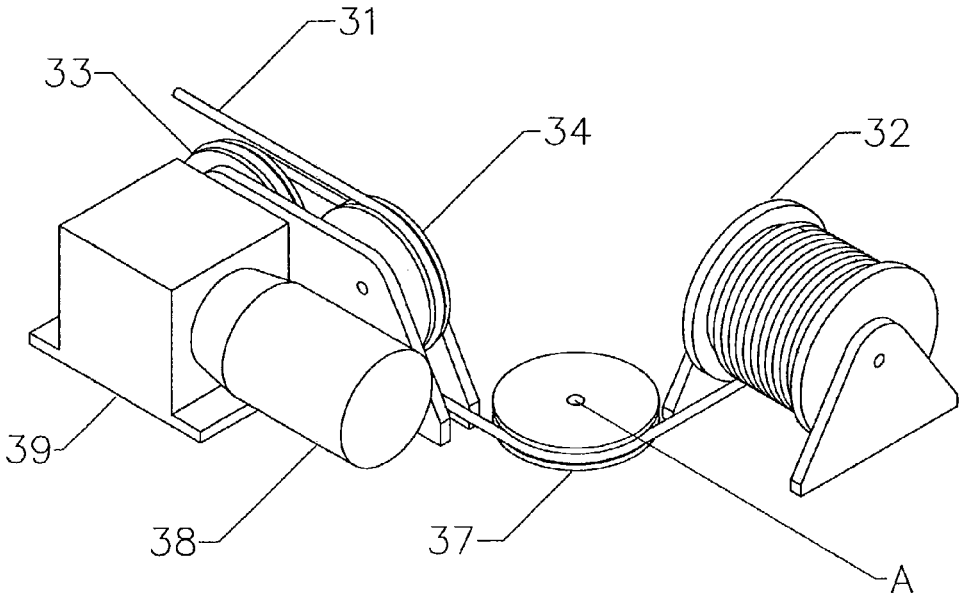
FIG. 4 is a perspective view of another embodiment with two driven sheaves, a rope guide and a take-up drum where not all of the axes of rotation are parallel.

A further embodiment of the winch system is shown in FIG. 4. This illustrates a compact sheave arrangement that allows the rope 31 to be spooled in an orderly manner on take-up drum 32. An additional sheave 37 is provided with a mechanism (not shown) to cause it to oscillate along the axis indicated by the letter A. Such reciprocating mechanisms are in widespread use and are therefore not described in detail. The angle at which rope 31 enters sheave 33 does not vary as sheave 37 oscillates along axis A thereby preventing wear of rope 31 from contact with the flanges of sheave 33. If this oscillation is synchronized with the rotation of drum 32 the rope 31 will be neatly coiled—this prevents subsequent layers of rope 31 from being forced between underlying coils, which can result in damage to the rope 31.

In all of the embodiments described above it is preferred that the drum and sheaves have radii at least 15 times that of the rope. This can prevent premature failure of the rope that has been observed when it is bent around small radii. It is not, however, necessary that the drum and sheaves have identical radii. Rather, radii can be chosen to vary the rotational speed of different components if desired.

Figure 6:
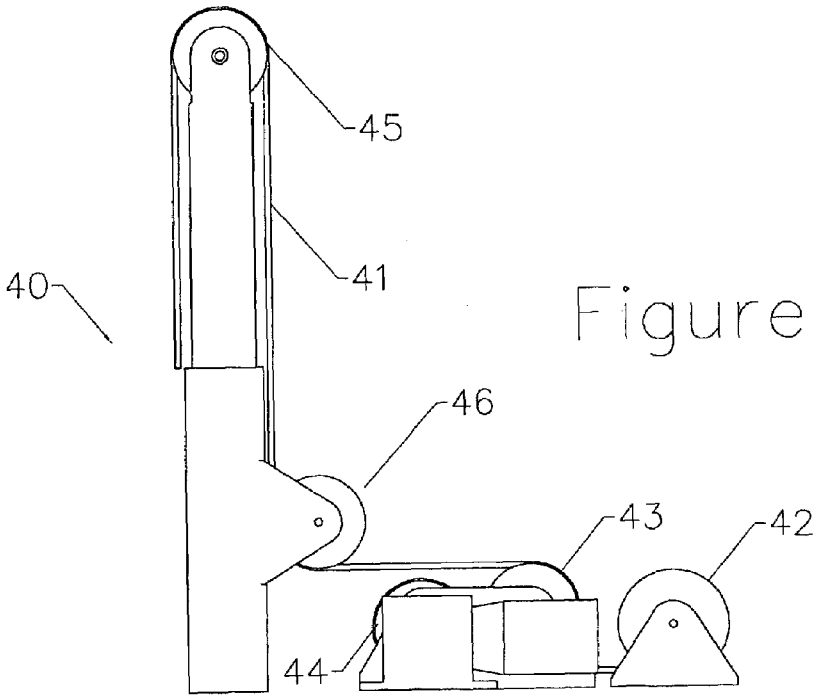
FIG. 6 is a perspective view of an embodiment that includes a ram tensioner acting in series.

Other components may be combined with the winch system described above to further improve its performance. FIG. 6 shows a hydraulic ram tensioner 40, such as is commonly used on deep-sea oil platforms and in naval replenishment systems, used in con junction with a winch system. Additional sheaves 45 and 46 are used to complete the path of rope 41. Ram tensioners are used to maintain a constant tension in a rope while a suspended load is oscillating. This ram tensioner 40 is connected to an accumulator (not shown) so that hydraulic pressure can be maintained by a relatively low-powered compressor (not shown). If used in series with the winch system the power required to drive sheaves 43 and 44 is reduced since the tensioner 40 can respond to oscillations, producing rapid movement of rope 41 beyond sheave 45.

While the invention has been described in connection with preferred embodiments, it is not intended to limit the scope of the invention to the particular forms set forth, but on the contrary, it is intended to cover such alternatives, modifications, and equivalents as may be included within the spirit and scope of the invention as defined by the appended claims.

What is claimed is:

1. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said flexible tensile member is wound onto said winch or take-up reel at a tension substantially lower than that of said flexible tensile member at its opposite end.

2. The device of claim 1 wherein said flexible tensile member is wound onto said winch or take-up reel at a tension at least 50% lower than that of said flexible tensile member at its opposite end.

3. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said device is used in series with a hydraulic ram.

4. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said winch or take-up reel and said at least one traction sheave rotate about parallel axes.

5. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said winch or take-up reel and said at least one traction sheave do not all rotate about parallel axes.

6. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said means to apply torque to said winch or take-up reel is independent of said means to apply torque to said at least one traction sheave, wherein the torque applied to said winch or take-up reel is lower than the torque applied to each of said at least one traction sheave.

7. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said means to apply torque to said winch or take-up reel is independent of said means to apply torque to said at least one traction sheave, wherein the torque applied to each of said at least one traction sheave is not identical.

8. A device that applies tension to a flexible tensile member comprising:

said flexible tensile member;

a winch or take-up reel to which said flexible tensile member is attached;

a means to apply torque to said winch or take-up reel;

at least one traction sheave and means to apply torque to said at least one traction sheave, wherein said means to apply torque to said winch or take-up reel is independent of said means to apply torque to said at least one traction sheave, wherein more than one traction sheave is driven by a single AC induction motor.

* * * * *